US007062938B2

(12) United States Patent
Lee

(10) Patent No.: US 7,062,938 B2
(45) Date of Patent: Jun. 20, 2006

(54) CONDENSING SYSTEM IN A COOLING SYSTEM

(76) Inventor: Chul Soo Lee, 599-2 Donae-dong, Deokyang-ku, Koyang city, 441-062 Kyungki-do (KR)

( * ) Notice: Subject to any disclaimer, the term of this patent is extended or adjusted under 35 U.S.C. 154(b) by 37 days.

(21) Appl. No.: 10/512,663

(22) PCT Filed: May 7, 2003

(86) PCT No.: PCT/KR03/00905

§ 371 (c)(1),
(2), (4) Date: Oct. 26, 2004

(87) PCT Pub. No.: WO03/095905

PCT Pub. Date: Nov. 20, 2003

(65) Prior Publication Data

US 2005/0198995 A1 Sep. 15, 2005

(30) Foreign Application Priority Data

May 10, 2002 (KR) ..... 10-2002-0025899
Apr. 21, 2003 (KR) ..... 20-2003-0012178 U

(51) Int. Cl.
*F25B 39/04* (2006.01)

(52) U.S. Cl. ..... 62/506

(58) Field of Classification Search ..... 62/183, 62/506, 507
See application file for complete search history.

(56) References Cited

U.S. PATENT DOCUMENTS 4,918,943 A 4/1990 Faust
5,003,789 A * 4/1991 Gaona et al. ..... 62/304
5,186,242 A 2/1993 Adachi et al.
5,377,500 A 1/1995 Yang
5,636,528 A 6/1997 Sasaki
5,950,445 A 9/1999 Wang
6,619,059 B1 * 9/2003 Johnson, Sr. ..... 62/171

* cited by examiner

*Primary Examiner*—Melvin Jones
(74) *Attorney, Agent, or Firm*—Nath & Associates PLLC; Gregory B. Kang; Stan N. Protigal

(57) ABSTRACT

Disclosed is a condensing system which can selectively provide cooperative operation of an air cooling condenser with a water cooling condenser or an evaporative condenser according to variation of ambient air temperature, coolant pressure and condensing load. The water cooling condenser is disposed between a compressor and the air cooling condenser, and includes a coolant pipe, a water passage for enabling water to flow therethrough to have heat exchange with coolant in the coolant pipe, an inlet pipe and an outlet pipe connected with the water passage of the water cooling condenser for automatically feeding and discharging water in a direction reverse to a flowing direction of coolant and a control valve installed in the inlet side of the inlet pipe for automatically controlling water feed to the water passage according to ambient air temperature, coolant pressure and condensing load. Alternatively, the evaporative condenser is disposed between the compressor and the air cooling condenser, in which the evaporative condenser is placed in the air discharge side of the air cooling condenser to evaporate moisture via air forcibly introduced by a condenser fan and coolant so that coolant can be condensed via latent heat of vaporization. Otherwise, a water pipe is selected from a middle one of chambers of coolant pipes, the coolant pipes are folded and fins are interposed between folded regions of the coolant pipes.

13 Claims, 6 Drawing Sheets

(a)

(b)

CONDENSING SYSTEM IN A COOLING SYSTEM

TECHNICAL FIELD

The present invention relates to a condensing system in a cooling system, in particular, which can selectively provide cooperative operation of an air cooling condensing unit with a water cooling condensing unit or an evaporative condensing unit according to variation of ambient air temperature, coolant pressure and condensing load in order to improve condensation efficiency, actively cope with rapid variation of ambient air temperature, reduce power consumption and enable a compact design of the condenser.

BACKGROUND ART

As well known in the art, a cooling system includes various machines such as a refrigerator, an air conditioner, etc. Each cooling system has a number of components including an evaporator, a compressor, a condenser and an expansion valve. The cooling system circulates coolant through a cooling cycle in order to obtain cold air through contact between coolant and air. In the cooling cycle, compressed gaseous coolant of high temperature and pressure from the compressor is cooled in the condenser and converts into liquid coolant. Liquid coolant is decompressed while passing through the expansion valve, and via heat exchange with indoor air in the evaporator, evaporated to gaseous coolant of low temperature and pressure, which is sucked again into the compressor so that the cooling cycle can be performed repeatedly. In the evaporator, coolant deprives air of heat via heat exchange to generate cold air, which is used to carry out freezing, refrigeration, cooling, and so on.

The condenser is an important component for condensing high temperature and pressure gaseous coolant from the compressor into liquid. An air cooling type condenser is typically used, in which a number of fins are mounted on a heat transfer pipe for enabling coolant to flow therethrough and a condenser fan is disposed in the front of the condenser so that the ambient air forcibly introduced by the condenser fan can perform heat exchange with coolant flowing through the heat transfer pipe.

However, in the case where the cooling system is applied in a region having a large value of annual temperature variation and a large value of daily temperature gap during change of seasons, the area of the condenser is generally designed based upon the highest ambient temperature to increase an average heat transfer area. This structure is suitable in terms of condensation efficiency in the summer where ambient air temperature is high. However, in the winter where ambient air temperature is low, the condenser may be unnecessarily large since sufficient condensation effect can be realized even with a substantially small heat transfer area. As the condenser becomes unnecessarily large, there are many problems in that the cost for raw material rises, it is difficult to handle the condenser, the condenser occupies a large installation space, and power consumption is increased.

In view of these problems, the condenser can be designed as a water cooling or evaporative type. However, the water cooling condenser requires a sufficient amount of water to increase the volume of the cooling system while creating risk of freezing and breaking in the winter. The evaporative condenser also increases its volume as outer area necessary for installation of an evaporator and/or related components is increased. The evaporative condenser having a small volume makes it difficult to install.

DISCLOSURE OF INVENTION

The present invention has been made in view of the foregoing problems, and it is therefore an object of the invention to provide a condensing system in a cooling system, in which an air cooling condensing unit is combined with a water cooling condensing unit or an evaporative condensing unit so that only the air condensing unit is operated or the air condensing system is operated in combination with the water cooling condensing unit or the evaporative condensing unit to perform a condensing function so as to improve condensation efficiency, save power consumption and reduce the size of the condensing system, thereby saving manufacturing cost, ensuring convenient handling and improving productivity.

BRIEF DESCRIPTION OF THE DRAWINGS

FIGS. 2A to 2D illustrate examples of a water cooling condenser according to the first embodiment of the invention, in which FIG. 2A shows a double pipe condenser, FIG. 2B shows a plate condenser, FIG. 2C shows fluid pipes which are spirally twisted in parallel with each other, and FIG. 2D shows serpentine fluid pipes which are folded in parallel with each other;

FIGS. 4A and 4B schematically illustrate the structure of a condensing system according to a second embodiment of the invention, in which FIG. 4A shows the overall structure of the condensing system, and FIG. 4B shows in detail a water tank adopted in the condensing system in FIG. 4A; and FIGS. 5A and 5B schematically illustrate the structure of a condensing system according to a third embodiment of the invention, in which FIG. 5A shows the overall structure of the condensing system, and FIG. 5B shows in detail an important part of a condensing pipe in FIG. 5A.

BEST MODE FOR CARRYING OUT THE INVENTION

The following detailed description will present preferred embodiments of the invention in reference to the accompanying drawings.

FIRST EMBODIMENT

Figure 1:
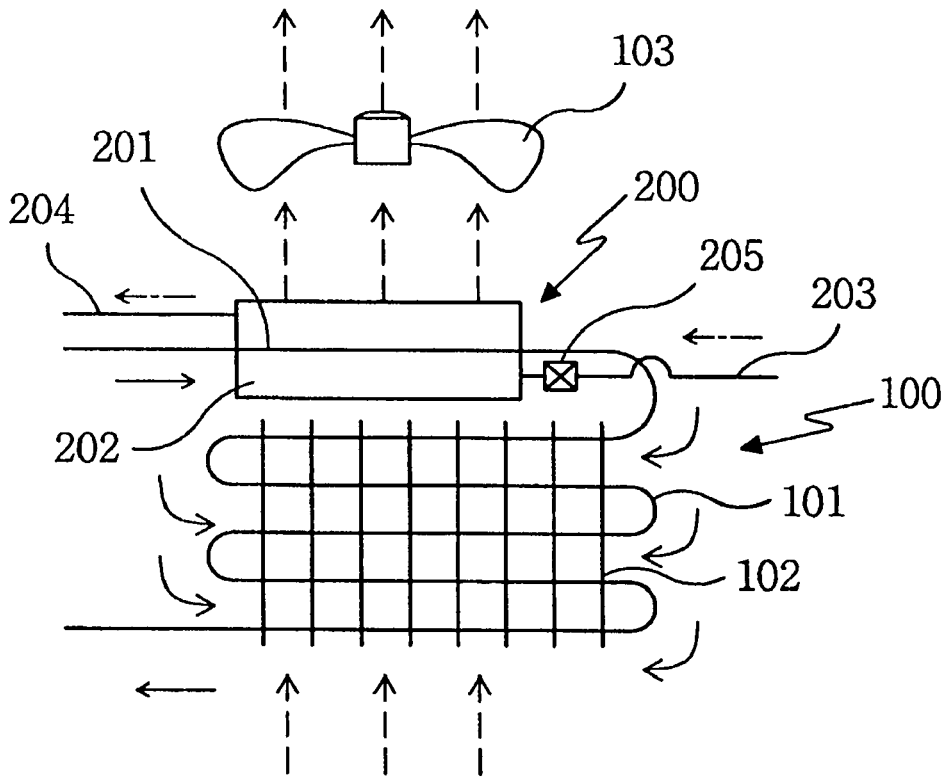
FIG. 1 schematically illustrates the structure of a condensing system of a cooling system according to a first embodiment of the invention.

FIG. 1 illustrates a condensing system according to a first embodiment of the invention. The condensing system comprises an air cooling condenser 100 and a water cooling condenser 200 mounted on a coolant pipe 201 between the air cooling condenser 100 and a compressor (not shown). The air cooling condenser 100 includes a serpentine heat transfer pipe 101, which is folded so that coolant of high temperature and pressure from the compressor flows through the heat transfer pipe 101, a number of fins 102 mounted on the heat transfer pipe 101 and a condenser fan 103 installed in the front of the air cooling condenser 100. The condenser fan 103 forcibly introduces the ambient air so that the ambient air is guided by the fins 102 to have heat exchange with coolant flowing through the heat transfer pipe 101. The water cooling condenser 200 includes the coolant pipe 201, a water passage 202 for enabling water to flow therethrough to have heat exchange with coolant in the coolant pipe 201, an inlet pipe 203 and an outlet pipe 204 connected with the water passage 202 of the water cooling condenser 200 for automatically feeding and discharging water in a direction reverse to a flowing direction of coolant and a control valve 205 installed in the inlet side of the inlet pipe 203 for automatically controlling water feed to the water passage 202 according to ambient air temperature, coolant pressure and condensing load.

Figure 2:
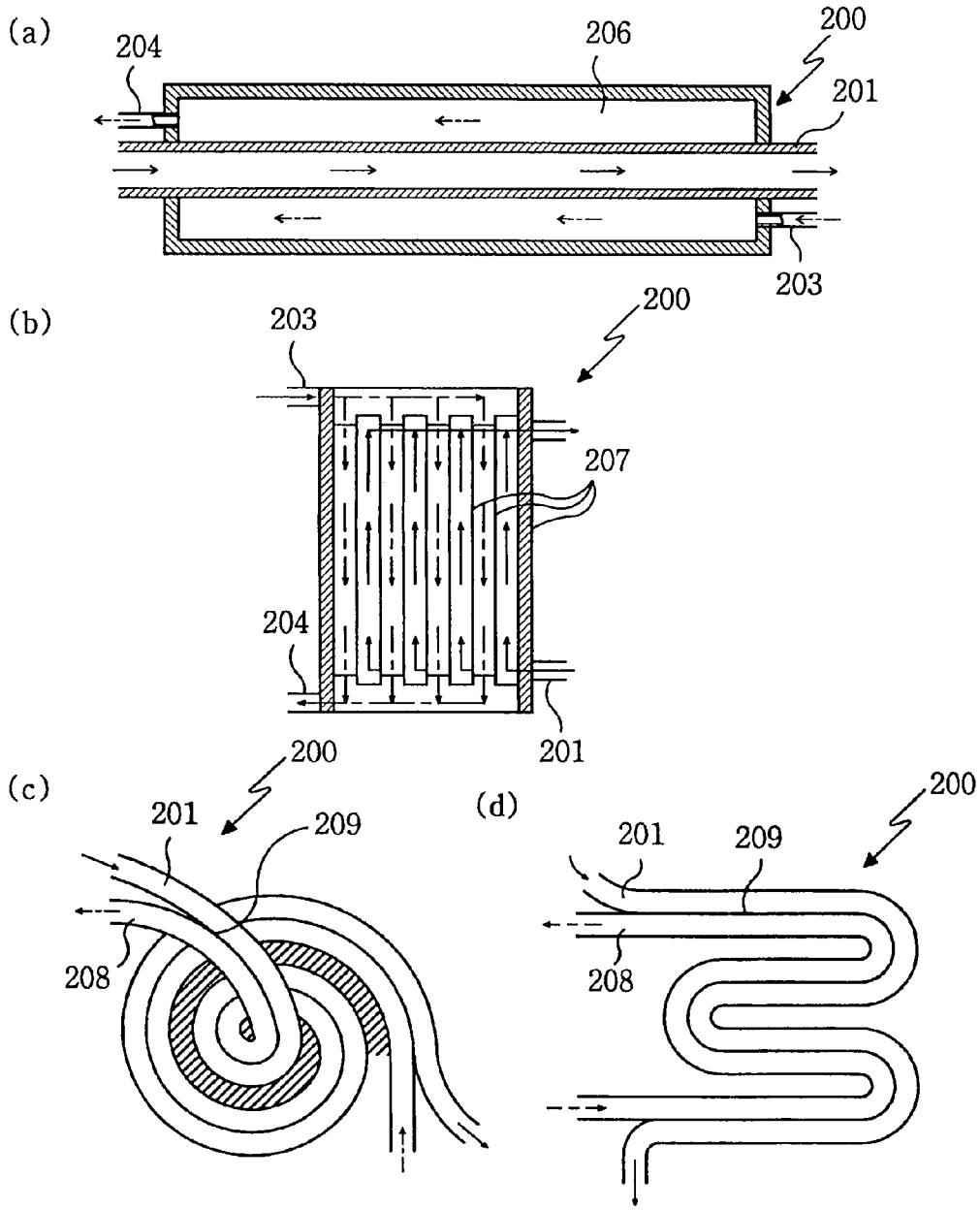

The water coolant condenser 200 can have any structure capable of performing heat exchange between coolant and water of different temperatures, and as shown in FIG. 2, available examples thereof may include a double pipe structure in which water flows through an outer pipe 206 so that coolant of high temperature and pressure can have heat exchange with water of relatively lower temperature, an overlapped plate structure having a plurality of plates 207 to form serpentine passages in which coolant of high temperature and pressure and water of relatively lower temperature flow as isolated from each other while having heat exchange with each other, and a partitioned structure in which a water pipe 208 for feeding water is disposed in parallel with the coolant pipe 201 via a partition 209 so that coolant of high temperature and pressure can have heat exchange with water of relatively lower temperature via the partition 209.

The water cooling condenser 200 is disposed in the air discharge side of the water cooling condenser 100 so that the air can secondly contact the water cooling condenser 200 after it is forcibly introduced by the condenser fan 103 and flows through the air cooling condenser 100. This structure of the condensing system can separately realize air and water cooling condensers as well as maximize cooling efficiency through second contact with the air of relatively lower temperature than coolant. In the case where the water pipe 208 is disposed in parallel with the coolant pipe 201 via the partition 209, parallel regions of the water and coolant pipes 208 and 201 can be twisted spirally about the coolant inlet side or folded in a serpentine configuration while maintaining tight contact with each other. As a result, both heat transfer area and time can be increased to obtain more efficient cooling.

Figure 3:
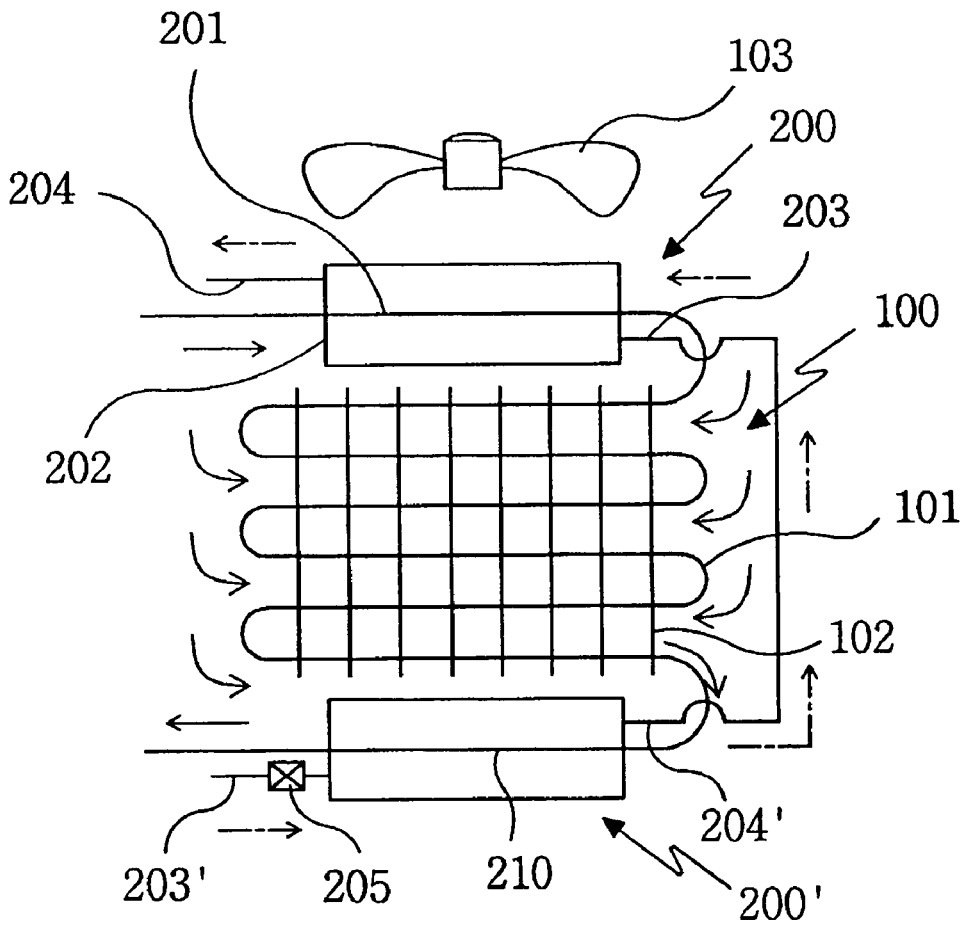
FIG. 3 schematically illustrates the structure of an alternative to the condensing system in FIG. 1 which further comprises a second water cooling condenser.

Also, as shown in FIG. 3, the condensing system may further comprise a second water cooling condenser 200' which is disposed on a downstream liquid pipe 210 of the heat transfer pipe 101 of the water cooling condenser 100 and has a water inlet pipe 203' and a water outlet pipe 204' so that water flows through a passage adjacent to the fluid pipe 210 to have heat exchange between fluids. In this case, the outlet pipe 204' of the water cooling condenser 200' on the downstream liquid pipe 210 of the heat transfer pipe 101 of the air cooling condenser 100 is connected with the inlet pipe 203 of the water cooling condenser 200 disposed on the coolant pipe 201 between the compressor and the air cooling condenser 100 so that water can have heat exchange with coolant in twice.

Since the air cooling condenser 100 can compensate any insufficient cooling via the water cooling condenser of the invention, the size can be reduced to about the half of a typical air cooling condenser in use for a conventional cooling system. Although not shown, a temperature sensor for measuring ambient air temperature can be installed in a side of cooling system. A pressure sensor can be installed in the coolant pipe to measure coolant pressure. Then, a separate controller is needed to operate the control valve by calculating detection signals from the sensors.

In FIGS. 1 to 3, arrows in solid lines indicate the flow of coolant, hidden lines indicate the flow of air, and one-dot chain lines indicate the flow of water. In FIG. 2C, a hatched region indicates a hollow space.

The following description will present the operation of the condensing system in the cooling system according to the first embodiment of the invention having the above structure.

Compressed coolant of high temperature and pressure from the compressor is primarily introduced into the air cooling condenser 100 to pass primarily through the water cooling condenser 200. The water cooling condenser 200 has the double pipe structure to introduce water through the outer pipe 206 or the plate pipe structure having the plurality of overlapped pipes 207 defining the serpentine passages through which coolant and water flow in separate relate to each other. Otherwise, the water pipe 208 for enabling water passage therein is disposed in parallel with the coolant pipe 201 via the partition 209. In the case where the water cooling condenser 200 has the double pipe structure, coolant of high temperature and pressure performs heat exchange with water of relatively lower temperature which flows through the outer pipe 206. in the case where the water cooling condenser 200 has the plate pipe structure, high temperature and pressure coolant performs heat exchange with water flowing through the adjacent passages via the plates 207. In the case where the coolant pipe 201 is disposed in parallel with the water pipe 208, coolant performs heat exchange with water via the partition 209. As a result, coolant is primarily cooled through one of the above steps.

Further, since the water cooling condenser 200 is placed in the air discharge side of the air cooling condenser 100, air forcibly introduced by the condenser fan 103 contacts the water cooling condenser 200 when air is primarily discharged via the fins 102 and the heat transfer pipe 101. Even though primarily heated, air has relatively lower temperature in comparison with high temperature and pressure coolant and thus performs heat exchange with coolant inside the coolant pipe 201 so that coolant within the coolant pipe 201 can be secondly condensed.

In the case where the water pipe 208 is disposed in parallel with the coolant pipe 201 via the partition 209, the parallel regions of the water pipe 208 and the coolant pipe 201 can be twisted spirally about the coolant inlet side or folded in a serpentine configuration maintaining tight contact with each other. As a result, the coolant pipe 201 and the water pipe 208 can be alternately disposed to enlarge the heat transfer area as well as prolong the passages of coolant and/or water, thereby increasing heat transfer time. Then, the condensation efficiency of coolant can be further enhanced.

After first and second heat exchange in a region of the water cooling condenser 200, coolant is continuously introduced to the air cooling condenser 100 to perform third heat exchange with the ambient air which is forcibly introduced by the condenser fan 103. Then, the coolant temperature is further lowered so that coolant can mostly condensed into liquid having room temperature and high pressure.

In the case where the water cooling condenser 200' having the water inlet pipe 203' and the water outlet pipe 204' is mounted on the downstream liquid pipe 210 of the heat transfer pipe 101 of the water cooling condenser 100 so that water can flow through the passage adjacent to the liquid pipe 210 to have heat exchange with coolant, coolant flowing through the heat transfer pipe 101 can be introduced into the liquid pipe 210 of the water cooling condenser 200' after first to third heat exchange to have heat exchange with water again in the water cooling condenser 200'. Then, high temperature and pressure coolant compressed by the compressor performs heat exchange with water and/or air for four times. As a result, coolant can be introduced to the next step after completely condensed into liquid.

In the case where the water cooling condenser 200 is disposed between the compressor and the water cooling condenser 100 and the second water cooling condenser 200 is disposed downstream of the condenser 100, the water outlet pipe 204' of the water cooling condenser 200' mounted on the downstream liquid pipe 210 of the heat transfer pipe 101 of the air cooling condenser 100 is connected with the water inlet pipe 203 of the water cooling condenser 200 mounted on the coolant pipe 201 between the compressor and the water cooling condenser 100. After introduced into the water cooling condenser 200' downstream of the water cooling condenser 100, water is more or less elevated in temperature during fourth heat exchange with coolant which is lowered in temperature through first to third heat exchange steps. Then warmed water is fed into the water cooling condenser 200 between the compressor and the water cooling condenser 100. However, since the temperature of warmed water is lower than that of coolant having high temperature and pressured which is just discharged from the compressor, sufficient heat exchange effect can be realized.

As set forth above, the water cooling and air cooling condensers are operated in cooperation with each other. So, the condensing system of the invention can obtain improved condensing effect over the conventional air cooling condenser even though the condensing system of the invention has a much smaller size than that of the conventional air cooling condenser. Operation of the entire condensing system including the water cooling and air cooling condensers is carried out only when the ambient air temperature rises to year highs in the summer, heat transfer ability is reduced, or heat transfer load is rapidly elevated. If the ambient air temperature is lowered and/or the coolant pressure is reduced, the temperature sensor and/or pressure sensor detects the variation so that the control valve 205 interrupts water feed and only the air cooling condenser is operated. As a result, water remaining in the condensing system naturally evaporates, thereby protecting the system from freezing. Also, sufficient condensing effect can be obtained by actuating only the small sized air cooling condenser 100. Then, entire consumption of electric power can be saved as much as needed for actuating the water cooling condensers 200 and 200'.

SECOND EMBODIMENT

Figure 4:
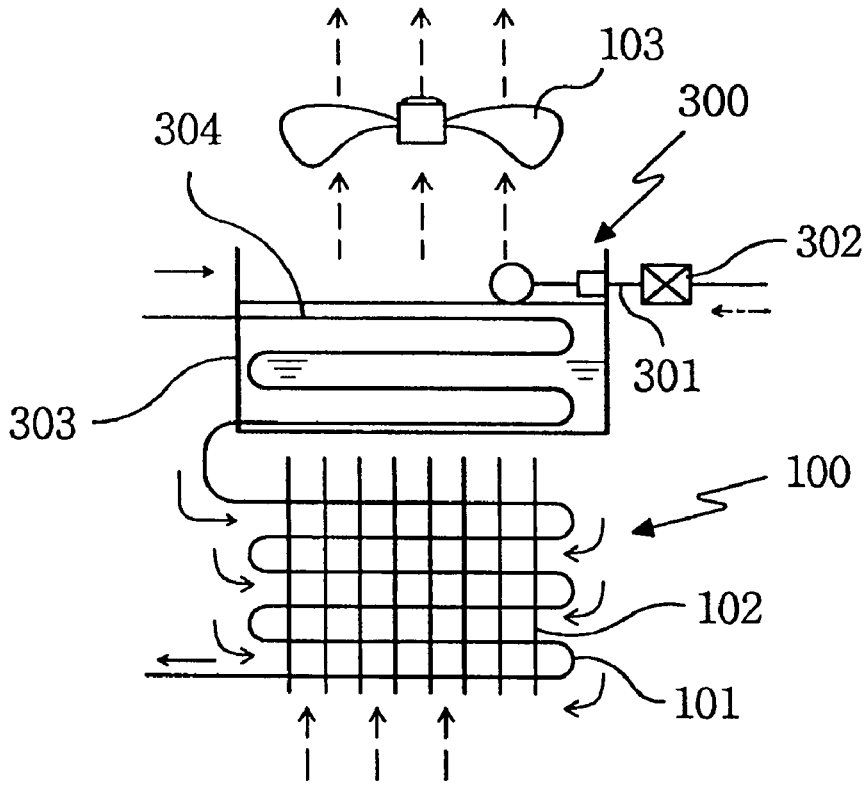
Figure 4:
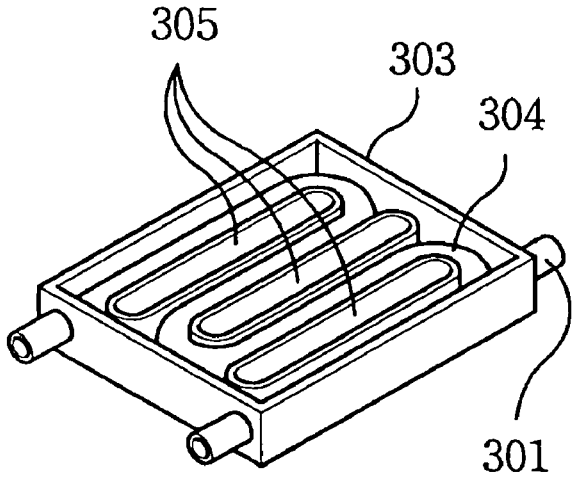

FIGS. 4A and 4B schematically illustrate the structure of a condensing system according to a second embodiment of the invention. The condensing system comprises an air cooling condenser 100 and an evaporative condenser 300 disposed between the air cooling condenser 100 and a compressor (not shown). The air cooling condenser 100 includes a serpentine heat transfer pipe 101, which is folded so that coolant of high temperature and pressure from the compressor flows through the heat transfer pipe 101, a number of fins 102 mounted on the heat transfer pipe 101 and a condenser fan 103 installed in the front of the air cooling condenser 100. The condenser fan 103 forcibly introduces the ambient air so that the ambient air is guided by the fins 102 to have heat exchange with coolant flowing through the heat transfer pipe 101. The evaporative condenser 300 has a substantially box-shaped water tank 303 disposed upstream of the air cooling condenser 100, a water inlet pipe 301 connected with the water tank 303 for enabling water to be automatically fed into the water tank 303 and a control valve 302 disposed in the inlet side of the water inlet pipe 301 for automatically controlling water feed to the water tank 303 according to ambient air temperature, coolant pressure and condensation pressure. In the evaporative condenser 300, a coolant pipe portion 304 between the compressor and the air cooling condenser 100 is immersed in water within the water tank 100. The outlet side of the coolant pipe portion 304 is connected with the inlet side of the heat transfer pipe 101 of the air cooling condenser 100 so that coolant flowing through the heat transfer pipe 101 can have heat exchange through contact with water having relatively lower temperature. The condenser fan 103 is disposed over the water tank 303. Air passages 305 are formed in the water tank 100, communicating with the bottom of the water tank 100, in an alternating manner with the coolant pipe portion 304 immersed in water within the water tank 303 so that the ambient air flows through the air passages 305 to evaporate water within the water tank 303 thereby condensing coolant within the coolant pipe portion 304 via latent heat of vaporization.

A float valve 306 is installed within the water tank 303 to float according to the water level thereof to open/close the water inlet pipe 301.

Since the air cooling condenser 100 can compensate any insufficient cooling via the water cooling condenser of the invention, the size can be reduced to about the half of a typical air cooling condenser in use for a conventional cooling system. Although not shown, a temperature sensor for measuring ambient air temperature can be installed in a side of cooling system. A pressure sensor can be installed in the coolant pipe portion 304 to measure coolant pressure. Separate from the float valve 306, a separate controller operates the control valve 302 by calculating detection signals from the sensors.

In FIGS. 4A and 4B, arrows in solid lines indicate the flow of coolant, hidden lines indicate the flow of air, and one-dot chain lines indicate the flow of water.

The condensing system of the cooling system according to the second embodiment of the invention having the above structure has the following operation.

Compressed coolant of high temperature and pressure from the compressor is primarily introduced into the air cooling condenser 100. Since the coolant pipe portion 304 between the compressor and the air cooling condenser 100 is immersed in water within the water tank 303, high temperature and pressure coolant performs heat exchange with water of lower temperature to lower the temperature thereof (water cooling condensing mode). As the condenser fan 103 is actuated, the ambient air flows through the air passages 305 in the water tank 303 to evaporate water within the water tank 303 so that latent heat of vaporization deprives coolant of heat to further lower the temperature of coolant (evaporative condensing mode). Coolant is continuously introduced to the heat transfer pipe 101 of the air cooling condenser 100 and the temperature of coolant is further lowered through heat exchange with the ambient air which is forcibly introduced by the condenser fan 103 (air cooling condensing mode). The above steps condense high temperature and pressure coolant into liquid, and the liquid coolant can be introduced to a next step.

As set forth above, the evaporative and air cooling condensers are operated in cooperation with each other. So, the condensing system of the invention can obtain improved condensing effect over the conventional air cooling condenser even though the condensing system of the invention has a much smaller size than that of the conventional air cooling condenser. Operation of the entire condensing system including the evaporative and air cooling condensers is carried out only when the ambient air temperature rises to year highs in the summer, heat transfer ability is reduced, or heat transfer load is rapidly elevated. If the ambient air temperature is lowered and/or the coolant pressure is reduced, the temperature sensor and/or pressure sensor detects the variation so that the control valve 302 blocks water and only the air cooling condenser 100 is operated. As a result, sufficient condensing effect can be obtained by actuating only the small sized air cooling condenser 100. Then, entire consumption of electric power can be saved as much as needed for actuating the evaporative cooling condenser 300.

Also, if water is filled up to a predetermined water level within the water tank 303 during operation of the evaporative and air cooling condensers, the float valve 306 floats according to the water level to automatically close the water inlet pipe 301 thereby blocking water feed to the water tank 303 so that water can maintain the water level constantly.

THIRD EMBODIMENT

Figure 5A:
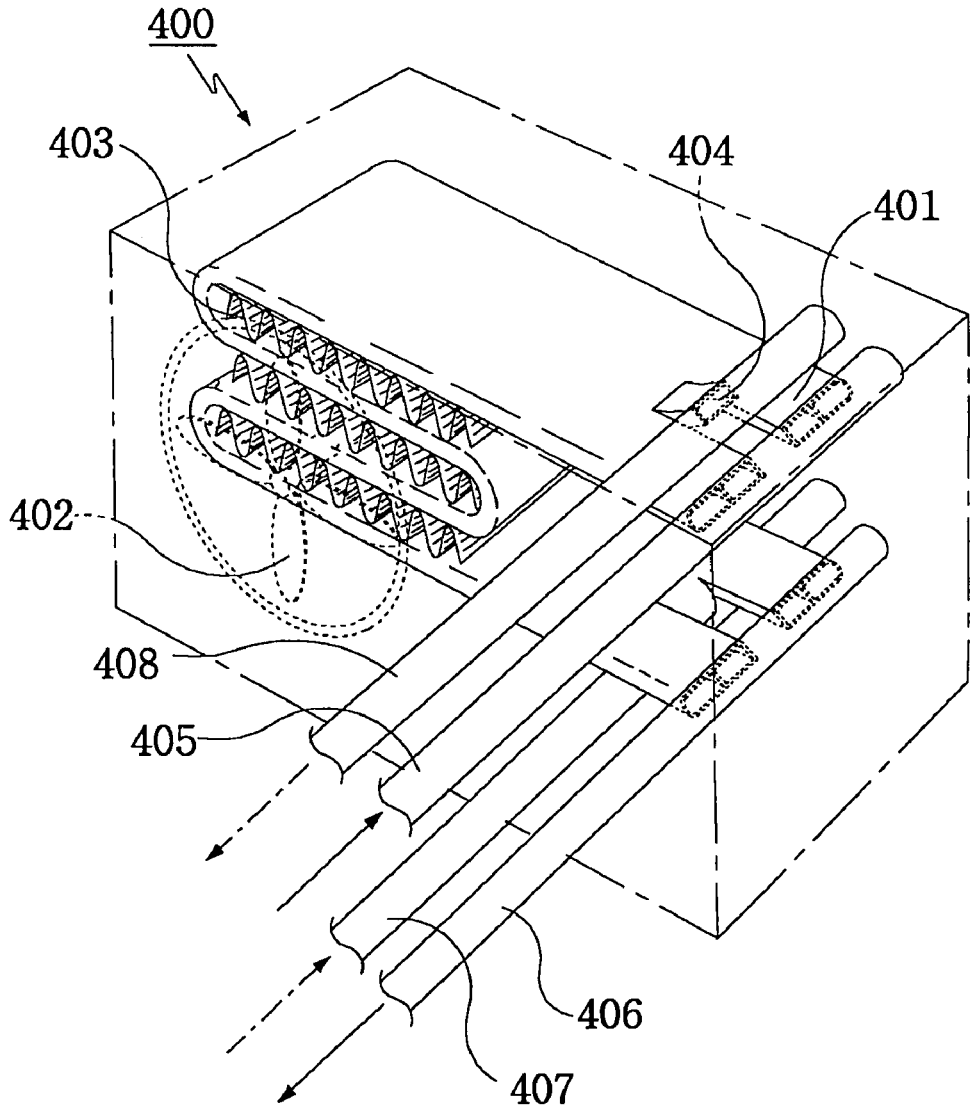
Figure 5B:
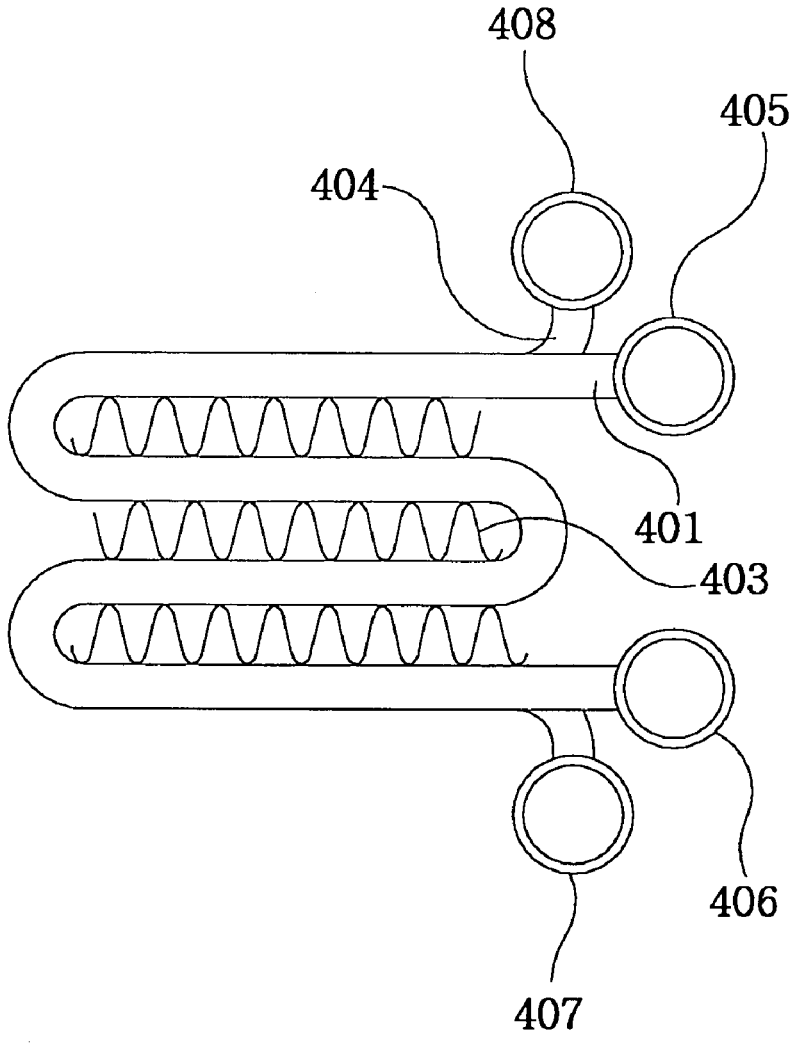

FIG. 5A schematically illustrates the structure of a combined condensing system 400 according to a third embodiment of the invention. The combined condensing system 400 has a combined structure of air and water cooling condensers. In the combined condensing system 400, compressed coolant of high temperature and pressure from a compressor (not shown) flows through coolant pipes 401 and is condensed through heat exchange with air which is forcibly introduced by a condenser fan 402 in front of the coolant pipes 401. The coolant pipes 401 are folded to a flat serpentine configuration and placed in the rear of the condenser fan 402 so that the coolant pipes 401 can contact with air. Continuously folded fins 403 are installed in spaces between folded regions of the coolant pipes 401 and fixedly brazed to straight regions of the coolant pipes 401. A water pipe 404 is disposed between the coolant pipes 401 to enable selective circulation of water.

The coolant pipes 401 are made of Al excellent in heat transfer performance through extrusion molding, and defined into a plurality of chambers allowing flow of coolant therethrough in order to disperse the pressure of coolant as well as ensure sufficient heat transfer area. The water pipe 404 is selected from a portion of the chambers.

A coolant inlet pipe 405 and a coolant outlet pipe 406 are connected respectively with both ends of the coolant pipes 401 so that coolant can diverge into the respective chambers or converge from the respective chambers. A water inlet pipe 407 is connected with one end of the water pipe 404 in the side of the coolant outlet pipe 406 and a water outlet pipe 408 is connected with the other end of the water pipe 404 in the side of the coolant inlet pipe 405 so that water can be introduced into the water pipe 404 at a region thereof adjacent to the coolant outlet side and discharged from the water pipe 404 at another region thereof adjacent to the coolant inlet side.

In FIG. 5A, arrows in solid lines indicate the flow of coolant, and one-dot chain lines indicate the flow of water.

The condensing system of the cooling system according to the third embodiment of the invention having the above structure has the following operation.

When is primarily introduced to the combined condenser 400 from the compressor, compressed coolant of high temperature and pressure flows through the coolant inlet pipe 405. Since the coolant inlet pipe 405 is connected with the coolant pipes 401 defined by the plurality of chambers, coolant can diverge into the respective chambers.

The coolant pipes 401 are folded to a flat serpentine configuration and the continuously folded fins 403 are interposed between the folded regions of the coolant pipes 401 to enlarge the heat transfer area between air forcibly introduced by the condenser fan 402 and coolant within the coolant pipes 401 so that coolant can continuously have heat exchange with air while winding through the folded regions of the coolant pipes 401 and thus be properly condensed. The other ends of the respective coolant pipes 401 are connected with the coolant outlet pipe 406 so that coolant condensed during circulation through the coolant pipes 401 converges in the coolant outlet pipe 406 and then is introduced to the next step.

The coolant pipes 401 are folded in a serpentine configuration to prolong passages thereby increasing heat exchange time and the continuously folded fins 403 are interposed between the folded regions of the coolant pipes 401, resultantly improving the condensation efficiency of coolant.

Accordingly, even though the size of the combined condenser 400 is reduced, the condensation ability thereof is not handicapped at all. Rather, it is apparent that reducing the size of the combined condenser 400 can obtain various effects including saved power consumption and manufacturing cost, facilitated operation and improved productivity.

The condensation efficiency of coolant can be lowered in a season such as summer as the ambient temperature rises. Then, the water cooling system is operated to compensate the efficiency, in which water is fed externally via the water inlet pipe 407 and flows through the water pipe 404. Since the coolant pipes 401 are placed at both sides of the water pipe 404 and the inlet side of water corresponds to the outlet side of coolant, direct heat exchange can be made between coolant discharged via the coolant pipes 401 and cold water introduced via the water pipe 404 to condense coolant via water cooling. Water warmed by depriving coolant of heat is discharged through the water outlet pipe 408 to the outside and then can be utilized as warm water.

Since coolant condensation can be carried in a water cooling mode where coolant performs heat exchange with water as well as in an air cooling mode where coolant performs heat exchange with air which is forcibly sucked in through operation of the condenser fan 402, sufficient condensation efficiency can be obtained even in the summer.

As set forth above, the water cooling and air cooling condensers are operated in cooperation with each other. So, the condensing system of the invention can obtain improved condensing effect over the conventional air cooling condenser even though the condensing system of the invention has a much smaller size than that of the conventional air cooling condenser. Operation of the entire condensing system including the water cooling and air cooling condensers is carried out only when the ambient air temperature rises to year highs in the summer, heat transfer ability is reduced, or heat transfer load is rapidly elevated. If the ambient air temperature is lowered and/or the coolant pressure is reduced, water feed is interrupted and only the air cooling condenser is operated. As a result, entire consumption of electric power can be saved as much as needed for actuating a water cooling section while sufficient condensing effect can be obtained by actuating only the small sized air cooling condenser.

Although not shown, a temperature sensor and/or a pressure sensor is installed in a portion of the combined condenser 400 and a control valve for water volume is mounted on the water passage so that the control valve can automatically control inflow of water according to ambient air temperature and coolant pressure. As a result, water remaining in the water pipe 404 naturally evaporates to protect the water pipe 404 from freezing in the winter even though the temperature drops below zero so that the lifetime of the condensing system can be prolonged.

Also, the condensing system of the invention is operated only in the air cooling mode for a long time, dirt may be held by the fins 102, 403 to remarkably degrade the condensation efficiency. In this case, if coolant pressure is detected and the water cooling condenser is automatically operated in response to detection, the condensation efficiency of coolant can be enhanced as well as the system can be protected from damage.

INDUSTRIAL APPLICABILITY

As set forth above, the present invention combines the water cooling condenser or the evaporative condenser with the small sized air cooling condenser instead of a general air cooling condenser, whereby the condensing system of the invention can operate the entire condensers to obtain full condensation effect or operate only the air cooling condenser according to ambient air temperature, coolant pressure and condensation load so as to actively cope with condensing action of coolant according to the variation in ambient air temperature. As a result, power consumption can be reduced since unnecessary parts are not operated and the overall size of the condensing system is reduced to save manufacturing cost so that the cooling system is readily handled and is installed in a small space, thereby increasing applications of the cooling system.

What is claimed is:

1. A condensing system in a cooling system comprising:

an air cooling condenser including a folded serpentine heat transfer pipe for enabling cooling of high temperature and pressure from a compressor to flow therethrough, a number of fins mounted on the heat transfer pipe and a condenser fan installed in the front of the air cooling condenser so that the ambient air forcibly introduced by the condenser fan is guided by the fins to have heat exchange with coolant flowing through the heat transfer pipe; and a water cooling condenser disposed between the air cooling condenser and the compressor in the cooling system, wherein the water cooling condenser includes:

a coolant pipe disposed between the compressor and the air cooling condenser, a water passage for enabling water to flow therethrough to have heat exchange with coolant in the coolant pipe, an inlet pipe and an outlet pipe connected with the water passage of the water cooling condenser for automatically feeding and discharging water in a direction reverse to a flowing direction of coolant, and a control valve installed at the inlet side of the inlet pipe for automatically controlling water feed to the water passage according to ambient air temperature, coolant pressure and condensing load.

2. The condensing system as set forth in claim 1, wherein the water cooling condenser has a double pipe structure in which water flows through an outer pipe so that coolant of high temperature and pressure can have heat exchange with water of relatively lower temperature.

3. The condensing system as set forth in claim 1, wherein the water cooling condenser has an overlapped plate structure in which a plurality of overlapped plates form serpentine passages so that coolant of high temperature and pressure and water of relatively lower temperature flow as isolated from each other while having heat exchange with each other.

4. The condensing system as set forth in claim 1, wherein the water cooling condenser has a partitioned structure in which a water pipe for feeding water is disposed in parallel with the coolant pipe via a partition so that coolant of high temperature and pressure can have heat exchange with water of relatively lower temperature via the partition.

5. The condensing system as set forth in claim 1, wherein the water cooling condenser is disposed in the air discharge side of the air cooling condenser so that air forcibly introduced by the condenser fan passes through the air cooling condenser and secondly contacts the water cooling condenser.

6. The condensing system as set forth in claim 4, wherein parallel regions of the water and coolant pipes and are twisted spirally about the coolant inlet side to increase heat transfer area and time.

7. The condensing system as set forth in claim 4, wherein parallel regions of the water and coolant pipes and folded in a serpentine configuration while maintaining tight contact with each other to increase heat transfer area and time.

8. The condensing system as set forth in claim 1, further comprising a second water cooling condenser disposed on a liquid pipe downstream of the heat transfer pipe of the water cooling condenser and having a water inlet pipe and a water outlet pipe so that water flows through a passage adjacent to the fluid pipe to have heat exchange between fluids.

9. The condensing system as set forth in claim 1, wherein the outlet pipe of the water cooling condenser on the liquid pipe downstream of the heat transfer pipe of the air cooling condenser is connected with the inlet pipe of the water cooling condenser disposed on the coolant pipe between the compressor and the air cooling condenser so that water can have heat exchange with coolant in twice.

10. A condensing system in a cooling system comprising:

an air cooling condenser including a folded serpentine heat transfer pipe for enabling coolant of high temperature and pressure from a compressor to flow therethrough, a number of fins mounted on the heat transfer pipe and a condenser fan installed in the front of the air cooling condenser so that the ambient air forcibly introduced by the condenser fan is guided by the fins to have heat exchange with coolant flowing through the heat transfer pipe; and an evaporative condenser disposed between the compressor and the air cooling condenser, wherein the evaporative condenser includes:

a substantially box-shaped water tank disposed upstream of the air cooling condenser, a water inlet pipe connected with the box-shaped water tank for enabling water to be automatically fed into the water tank, a control valve disposed in the inlet side of the water inlet pipe for automatically controlling water feed to the water tank according to ambient air temperature, coolant pressure and condensation pressure, a coolant pipe portion disposed between the compressor and the air cooling condenser and immersed in water within the water tank, the coolant pipe portion having an outlet side thereof being connected with an inlet side of the heat transfer pipe of the air cooling condenser so that coolant flowing through the heat transfer pipe can have heat exchange through contact with water having relatively lower temperature, an air passage formed in the water tank in an alternating manner with the coolant pipe portion immersed in water within the water tank to communicate with a bottom of the water tank, in which the condenser fan is disposed over the water tank so that the ambient air flows through the air passage to evaporate water within the water tank thereby condensing coolant within the coolant pipe portion via latent heat of vaporization, and a float valve disposed within the water tank to float according to the water level thereof to open/close the water inlet pipe.

11. A combined condensing system in a cooling system comprising:

air cooling means for introducing compressed coolant of high temperature and pressure from a compressor through a coolant pipe to be condensed through heat exchange with air forcibly introduced by a condenser fan in front of the coolant pipe; and water cooling condensing means for contacting the coolant pipe with a water pipe so that coolant within the coolant pipe can have heat exchange with water within the water pipe, wherein the coolant pipe is folded to a flat serpentine configuration and placed in the rear of the condenser fan so that the coolant pipe can contact with air, wherein continuously folded fins are installed in spaces between folded regions of the coolant pipe and fixedly brazed to straight regions of the coolant pipe and fixedly brazed to straight regions of the coolant pipe, and wherein a water pipe is disposed between the coolant pipes to enable selective circulation of water.

12. The combined condensing system as set forth in claim 11, wherein the coolant pipe has a plurality of chambers allowing flow of coolant therethrough in order to disperse the pressure of coolant as well as ensure sufficient heat transfer area, and wherein the water pipe is selected from a portion of the chambers.

13. The combined condensing system as set forth in claim 11, further comprising:

a coolant inlet pipe and a coolant outlet pipe connected respectively with both ends of the coolant pipes so that coolant can diverge in to the respective chambers or converge from the respective chambers, a water inlet pipe connected with one end of the water pipe in the side of the coolant outlet pipe, and a water outlet pipe connected with the other end of the water pipe in the side of the coolant inlet pipe, whereby water can be introduced into the water pipe at a region thereof adjacent to a coolant outlet side and discharged from the water pipe at another region thereof adjacent to a coolant inlet side.

* * * * *